United States Patent [19]

Shuttleworth

[11] 3,999,773

[45] Dec. 28, 1976

[54] COMBINATION SKI BOOT SCRAPER AND ANTI-THEFT DEVICE

[76] Inventor: James H. Shuttleworth, 4529 W. Lakewood Road, McHenry, Ill. 60050

[22] Filed: Nov. 24, 1975

[21] Appl. No.: 634,451

[52] U.S. Cl. ..... 280/11.37 E; 15/237; 280/11.37 K

[51] Int. Cl.[2] ..... A63C 11/18; A47L 23/22

[58] Field of Search ..... 280/11.37 E, 11.13 T, 280/11.13 R, 11.37 R, 611, 11.37 K; 15/237

[56] References Cited

UNITED STATES PATENTS

| | | | |
|---|---|---|---|
| 890,097 | 6/1908 | Roesken | 15/237 |
| 2,176,917 | 10/1939 | Mayers | 15/237 |
| 2,904,127 | 9/1959 | Sarno | 15/237 X |
| 3,284,091 | 11/1966 | Spier | 280/11.37 E X |
| 3,727,934 | 4/1973 | Averbook et al. | 280/11.37 K |
| 3,826,022 | 7/1974 | Grzech | 15/237 X |
| 3,826,518 | 7/1974 | Hennig | 280/11.37 E X |

FOREIGN PATENTS OR APPLICATIONS

| | | | |
|---|---|---|---|
| 225,050 | 8/1901 | Germany | 280/11.13 T |

*Primary Examiner*—Philip Goodman
*Assistant Examiner*—Milton L. Smith

[57] ABSTRACT

A combination boot scraper adapted to scrape the snow off the sole of a ski boot and an anti-theft device is disclosed. The combination boot scraper and anti-theft device comprises a flat substantially rectangular base having an upper surface and a lower surface. The lower surface of the base is adapted to contact and be affixed to an upper surface of a ski. The upper surface of the base has a rigid upstanding flange integrally formed therewith. The flange is generally coextensive with two opposing points along the periphery of the upper surface of the base. The flange has an arch defined therein which is adapted to receive a cable or other similar securing means for securing the ski to a fixed object. In a preferred embodiment, the base also has an aperture which is diagonally disposed in an opposite direction from the flange so that the arch in the flange and the aperture in the base cooperate to form a means for receiving a securing cable, or the like, through the combination ski scraper and locking device.

7 Claims, 5 Drawing Figures

COMBINATION SKI BOOT SCRAPER AND ANTI-THEFT DEVICE

BACKGROUND OF THE INVENTION

This invention relates to a combination boot scraper and anti-theft device adapted to be mounted on a ski. This device solves two problems commonly encountered by skiers which the prior art has not satisfactorily solved.

The first problem is that of removing snow buildup from the soles of ski boots. With modern bindings, it is virtually impossible to seal the boot properly within the binding unless all snow has been removed from the sole of the boot. Snow buildup is particularly a problem when a ski comes off, comes to rest downhill from the skier, and must be retrieved. At such times, it would be exceedingly helpful to have a satisfactory ski boot scraper available. Several boot scrapers have been provided in an attempt to solve this problem.

One such scraper is disclosed in U.S. Pat. No. 3,284,091. The scraper of U.S. Pat. No. 3,284,091 suffers from several disadvantages. The most serious disadvantage is found in the flexible flange which is slotted to provide additional flex. When subjected to continual wear, the teeth defined by the slots are likely to break off. Furthermore, the prior art scraper is affixed to the ski with an adhesive. While it may be convenient to initially peel off a backing and press the scraper onto the upper ski surface, the initial convenience will be outweighed by the later inconvenience when the scraper is removed during the scraping process. Reference is also made to U.S. Pat. Nos. 890,097, 2,904,127, 3,826,022, and 3,826,518.

The second problem skiers commonly face is ski theft. Most skiing facilities include a fixed object, such as, a post, to which skiers can lock their skis with one of the commercially available locking devices. The locking devices are generally similar to the chains or cables used to secure bicycles to posts. Ski bindings are presently used as a fastening means, that is, the cable is passed through the binding, around a post, or other fixed object, and locked. For a variety of reasons apparent to those skilled in the art, it is not entirely satisfactory to use the ski bindings as the means for securing skis to a post.

Accordingly, this invention provides an improved ski boot scraper which includes an aperture for receiving a means for lockably securing a ski to a fixed object, such as a post.

SUMMARY OF THE INVENTION

This invention provides a molded plastic combination ski boot scraper and anti-theft device adapted to be affixed to a ski. The combination ski boot scraper and anti-theft device of this invention has a flat, substantially rectangular base having an upper surface and a lower surface. The lower surface is adapted to contact the upper surface of the ski so that the base can be affixed to the ski. The scraper-anti-theft device is preferably held in place on the ski with one or more locking screws to prevent removal of the device in order to take the ski. A rigid upstanding flange is integrally formed with the upper surface of the base. The flange is disposed diagonally across the base and is generally coextensive with two opposing points along the periphery of the upper surface. The flange has an arch defined in the midportion thereof. The arch is sufficiently large to receive a cable or chain therethrough. While the aperture or arch in the flange could be used as the sole means for receiving a cable, or the like, therethrough, it is preferable to provide a substantially oval aperture in the base which is adapted to communicate with the arch in the flange and to cooperate therewith to facilitate receiving a cable, or other suitable ski securing means therethrough. It is preferred that the aperture be substantially oval shaped and be disposed in the opposite diagonal direction from the flange. A central portion of the flange generally bisects the center of the aperture in the base.

In order to avoid the drawbacks of the prior art boot scrapers, the flange is completely rigid and can be optionally reinforced, particularly around the arch area. To further avoid the drawbacks of the prior art, the base of the device is substantially larger than the flange. By that, it is meant that both the width and length of the base are substantially greater than the width of the flange.

In use, the device is mounted to a conventional ski, preferably in front of the boot binding, although it can be mounted in back of the boot binding, or alternatively, two devices are mounted on each ski, one in front of the binding and the other in back of the binding. The device is mounted so that the scraping flange is at an angle to the longitudinal axis of the ski. It will be understood that the flanges will be at opposing angles on opposite skis.

BRIEF DESCRIPTION OF THE DRAWINGS

The invention can be better understood by referring to the drawings wherein.

DETAILED DESCRIPTION OF THE PREFERRED EMBODIMENTS

Figure 1:
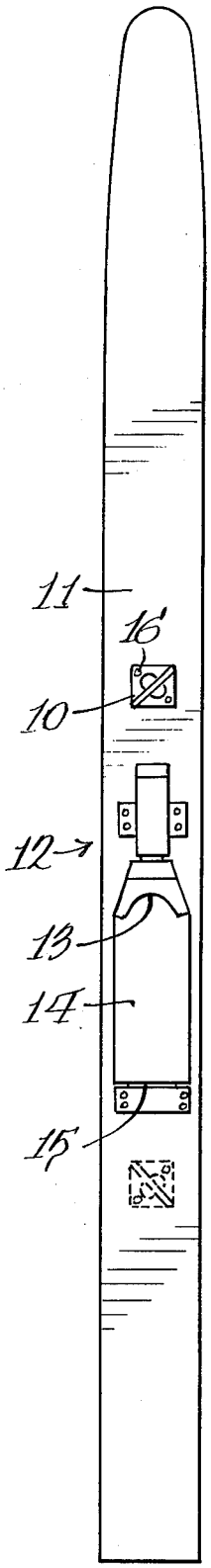
FIG. 1 is a top plan view of a ski having the device of this invention mounted thereon in front of the boot bindings.

While this invention is susceptible of embodiment in many different forms, there is shown in the drawings and will herein be described in detail a preferred embodiment of the invention, with the understanding that the disclosure is to be considered as an exemplification of the principles of the invention and is not intended to limit the invention to the embodiment illustrated. The scope of the invention will be pointed out in the appended claims.

Referring now to FIG. 1, the combination ski boot scraper and anti-theft device 10 of this invention is shown attached to the upper surface 11 of ski 12. Ski 12 may be any conventional ski. Device 10 is preferably a molded plastic unit. It is preferred that device 10 be mounted in front of the toe-receiving portion 13 of the boot binding 14, however, device 10 can be mounted in back of the heel-receiving portion 15 of boot binding 14, as shown in FIG. 1, or in both locations. Device 10 is preferably secured to ski 12 by one, or more locking screws 16.

Figure 2:
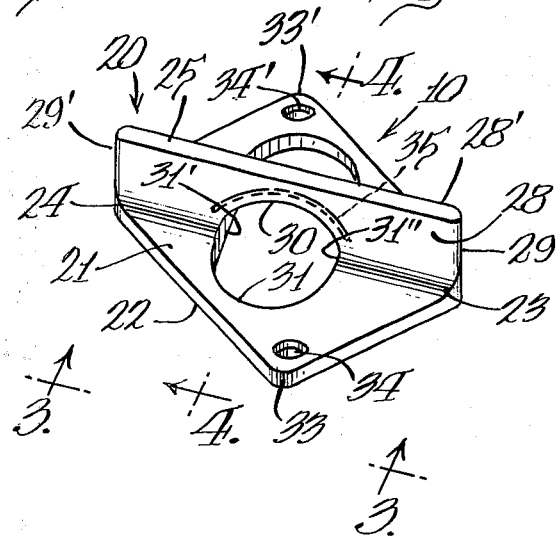
FIG. 2 is a perspective view of the device of this invention.
Figure 3:
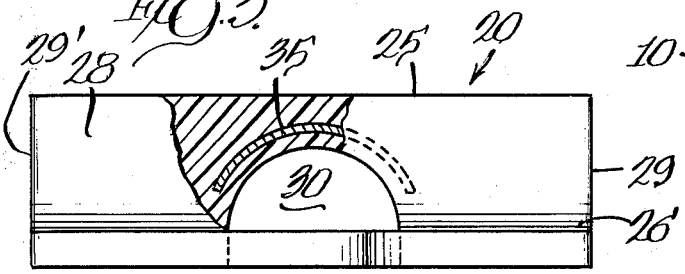
FIG. 3 is a cross-sectional view of the flange shown in FIG. 2, taken along lines 3—3 of FIG. 2.
Figure 4:
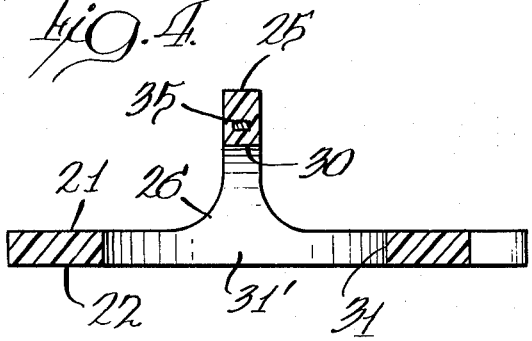
FIG. 4 is a cross-sectional view taken along lines 4—4 of FIG. 2.

As shown in FIGS. 2–4, device 10 comprises a flat, substantially rectangular base 19 having an upper surface 21 and a lower surface 22 and a rigid upstanding flange 20 integrally formed with the upper surface 21. The lower surface 22 of base 19 is adapted to contact upper surface 11 of ski 12 so that the base 19 of the device can be affixed to the ski. Ski 12 is illustrated as a left-handed ski.

Device 10 is molded from any suitable plastic, such as, acrylonitrile butadiene styrene, so that base 19 and flange 20 are of suitable thickness to be generally rigid. Flange 20 has a substantially flat scraping edge 25, a thickened base portion 26, opposing sidewalls 28 and 28' and end walls 29 and 29'. End walls 29 and 29' of flange 20 are generally coextensive with opposing corners 23 and 24 of the upper surface 21 of base 19, so that flange 20 is disposed diagonally along upper surface 21 of base 19.

Figure 5:
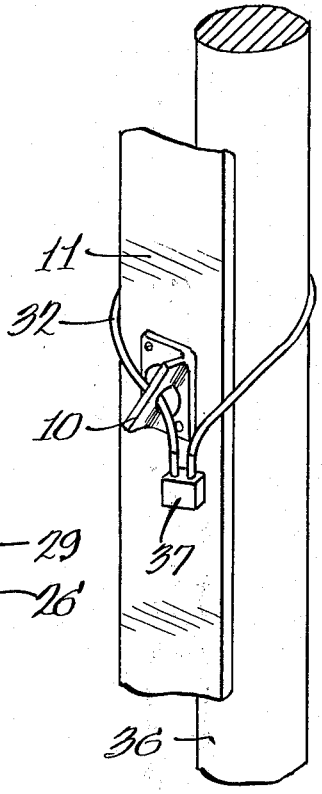
FIG. 5 is a perspective view of a ski securably fastened to a pole with the device of this invention.

Base 19 has a substantially oval aperture 31 which communicates with arch 30 in flange 20 to form a means for receiving a lockable securing means 32, such as, a cable, or chain, as shown in FIG. 5. Arch 30 also cooperates with the bridging portion of scraping edge 25 to effect a shearing action on accumulated or packed snow. Aperture 31 has opposing parallel sidewalls 31' and 31''. While it is feasible to simply provide an arch in the flange 20 for receiving securing means 32, the height of the flange would have to be increased and strength of flange 20 would have to be insured by additional reinforcing means. Therefore, in the preferred embodiment, an aperture 31 is diagonally disposed in base 19 between opposing corners 33 and 33' so that a central portion of flange 20 bisects the central portion of the opposing sidewalls 31' and 31'' of aperture 31. Screw holes 34 and 34', adapted to accommodate locking screws are disposed adjacent opposing corners 33 and 33'.

Flange 20 can additionally include reinforcing means 35 to insure rigidity in the area of the flange surrounding arch 30. Reinforcing means can be any rigid, strength-imparting material, but is preferably metal.

In one working example, base 19 had a length of 3 inches, a width of 2½ inches, and a thickness of ¼ inch. The length of scraping edge 25 was 3¾ inches and of aperture 31, 2 inches. Flange 20 had a height of approximately ½ inch, measured from the upper surface 21 of base 19 and was ¼ inch thick at the scraping edge 25.

While base 19 is substantially rectangular in the preferred embodiment, it can be a variety of configurations. However, for strength and stability, it is important that the width and length dimensions of the base be substantially greater than the width of the flange.

Turning now to FIG. 5, a typical lockable securing means 32, such as, a flexible cable resistant to cutting, is placed through arch 30 of flange 25 in device 10, slipped around security pole 36 and into lock 37. It will be understood that while securing means 32 could conceivably be slipped through a large enough flange arch, it is critical that aperture 31 cooperate with arch 30 to accommodate the commercially available securing means without raising the height of the flange and encountering possible structural weakness.

In the drawings, ski 12 is illustrated as a left-hand ski. It will be understood that device 10 is mounted on a right-hand ski, so that flange 25 will be disposed at an opposing angle to that of the left-hand ski.

What is claimed is:

1. A boot scraper and anti-theft device adapted to be mounted on a ski and comprising: a flat, substantially rectangular base having an upper surface and a lower surface, said lower surface adapted to be affixed to an upper surface of a ski, said upper surface having a rigid upstanding flange integrally formed therewith, said flange being generally coextensive with two opposing points along the periphery of said upper surface, said flange having an arch defined therein for receiving means for securing a ski to a fixed object, an aperture in said base communicating with said flange arch and cooperating therewith to facilitate receiving said ski securing means therethrough, and means for securing said combination boot scraper and anti-theft device to a ski.

2. The device of claim 1 wherein said arch is disposed in a central portion of said flange and wherein said base aperture is centrally disposed within said base.

3. The device of claim 2 wherein said base aperture is generally O-shaped.

4. The device of claim 3 wherein said base aperture is substantially oval and has first and second opposing parallel sidewalls, said aperture being disposed diagonally within said base so that the central portion of said flange bisects a substantially central point of each of the parallel opposing sidewalls of said aperture.

5. The device of claim 4 wherein said flange additionally includes means for reinforcing said flange.

6. The device of claim 5 wherein said flange reinforcing means is disposed along a central portion of said flange.

7. The device of claim 6 wherein the base additionally includes a first aperture for receiving means for lockably securing said base to a ski.

* * * * *